US005245791A

United States Patent [19]

Bigliano et al.

[11] Patent Number: 5,245,791

[45] Date of Patent: Sep. 21, 1993

[54] SCISSOR SHARPENING APPARATUS

[75] Inventors: Robert P. Bigliano, Wilmington; Daniel D. Friel, Greenville, both of Del.; Steven J. Gluck, Kennett Square, Pa.

[73] Assignee: Edgecraft Corporation, Avondale, Pa.

[21] Appl. No.: 867,325

[22] Filed: Apr. 13, 1992

Related U.S. Application Data

[60] Division of Ser. No. 636,399, Dec. 31, 1990, Pat. No. 5,148,634, which is a continuation-in-part of Ser. No. 396,974, Aug. 22, 1989, Pat. No. 5,005,319, which is a continuation-in-part of Ser. No. 304,323, Jan. 31, 1989, Pat. No. 4,897,965, which is a continuation-in-part of Ser. No. 917,601, Oct. 6, 1986, Pat. No. 4,807,399, which is a continuation-in-part of Ser. No. 588,794, Mar. 12, 1984, Pat. No. 4,627,194, and Ser. No. 855,147, Apr. 23, 1986, Pat. No. 4,716,689, which is a continuation-in-part of Ser. No. 588,795, Mar. 12, 1984, abandoned.

[51] Int. Cl.[5] ..... B24B 3/52; B24B 9/04

[52] U.S. Cl. ..... 51/128; 51/109 BS; 76/82.2

[58] Field of Search ..... 51/109 R, 109 BS, 108 BS, 51/110, 128, 74 BS, 76 BS, 77 BS, 80 BS, 81 BS, 82 BS, 83 BS, 84 BS, 85 BS, 86 BS, 87 BS, 91 BS, 92 BS, 98 BS, 285; 269/224, 254 R, 275

[56] References Cited

U.S. PATENT DOCUMENTS

| | | | |
|---|---|---|---|
| 2,203,788 | 6/1940 | Jenks | 51/285 |
| 2,775,075 | 12/1956 | McMaster et al. | 51/128 X |
| 2,841,926 | 7/1958 | Lebus | 51/128 |
| 3,071,899 | 1/1963 | Hicks et al. | 51/128 |
| 3,332,173 | 7/1967 | McMaster et al. | 51/128 |
| 3,334,446 | 8/1967 | Jager | 51/128 |
| 3,755,971 | 9/1973 | Garcia | 51/92 BS |
| 4,265,056 | 5/1981 | Yamamoto | 51/128 |
| 4,333,273 | 6/1982 | Roucau et al. | 51/102 |
| 4,612,731 | 9/1986 | Eckel | 51/109 BS |
| 4,915,709 | 4/1990 | Andrew et al. | 51/109 BS |

FOREIGN PATENT DOCUMENTS 2132520 7/1984 United Kingdom .

*Primary Examiner*—Bruce M. Kisliuk
*Assistant Examiner*—Bryan Reichenbach
*Attorney, Agent, or Firm*—Connolly & Hutz

[57] ABSTRACT

A scissors sharpening apparatus includes a motor driven sharpening member having an abrasive surface. A magnetic guide is arranged to position the scissors blade at a fixed angle relative to the principle plane of the abrasive surface in such a manner that the magnet of the guide has the axis of its poles oriented nominally perpendicular to the flat face of the blade and nominally parallel to the principle plane of the abrasive surface.

13 Claims, 2 Drawing Sheets

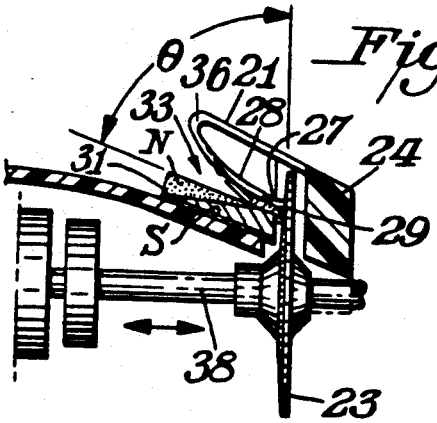
Fig.3.
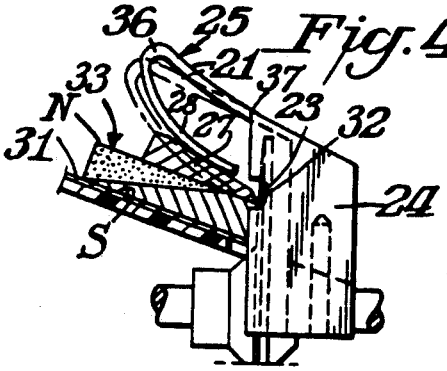
Fig.4.
Fig.7 (Prior Art)
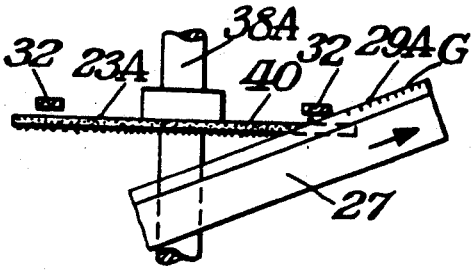
Fig.6.
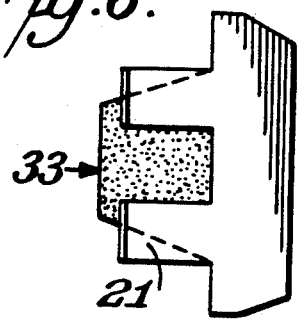
Fig.8.
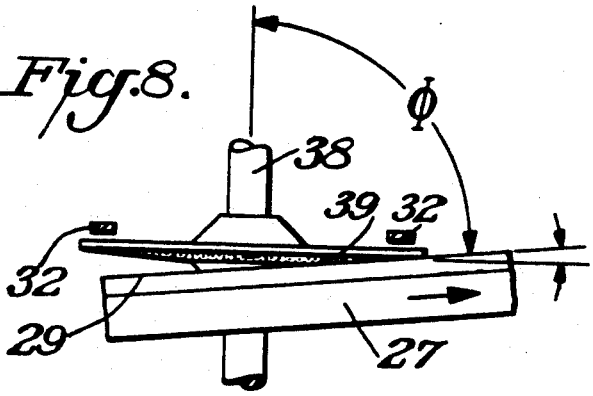
Fig.5.
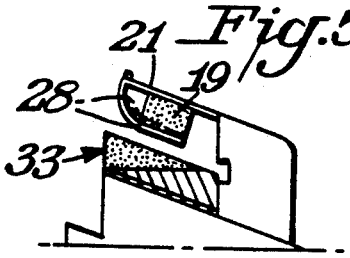
Fig.9A.
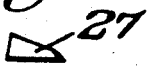
Fig.9C.
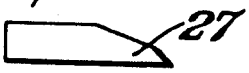
Fig.9B.
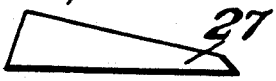
Fig.9D
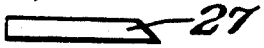

SCISSOR SHARPENING APPARATUS

CROSS-REFERENCE TO RELATED APPLICATIONS

This application is a division of U.S. application Ser. No. 636,399, filed Dec. 31, 1990, now U.S. Pat. No. 5,148,634, which is a continuation-in-part of U.S. application Ser. No. 396,974 filed Aug. 22, 1989, now U.S. Pat. No. 5,005,319 which in turn is a continuation-in-part of U.S. application Ser. No. 304,323 filed Jan. 31, 1989, now U.S. Pat. No. 4,897,965 which is a continuation-in-part of U.S. application Ser. No. 917,601 filed Oct. 6, 1986, now U.S. Pat. No. 4,807,399 which is a continuation-in-part of application Ser. No. 588,794 filed Mar. 12, 1984, now U.S. Pat. No. 4,627,194 and U.S. application Ser. No. 855,147 filed Apr. 23, 1986, now U.S. Pat. No. 4,716,689 which is a continuation-in-part of U.S. application Ser. No. 588,795 filed Mar. 12, 1984 now abandoned.

BACKGROUND OF THE INVENTION

The present invention relates to scissors sharpeners of the type which use a disk type sharpening member. Conventional sharpeners of this type have a tendency for the disks to grab and often forceably cause the user to lose physical control of the scissors when the scissors is positioned parallel to the disk face. In addition, the user loses control of the edge sharpening angle which results in a gouging, scalloping or otherwise creating the formation of undesirable grooves in the scissors blades. One of the difficulties with prior scissors sharpeners is the inability to take into account the unbalanced weight of the scissors handle which requires the user to carefully control the amplitude of applied force between the scissors and the rotating disk. The applied force in such prior art disk sharpeners is thus a strong function of the operator's techniques and skills as well as the scissors thickness and geometry and other design factors. Without proper control gouging and scalloping frequently occurs.

SUMMARY OF INVENTION

An object of this invention is to provide disk type scissors sharpening apparatus which overcomes the above indicated disadvantages of the prior art.

A further object of this invention is to provide such a scissors sharpening apparatus which minimizes burr formation and removes substantial portions of any burrs which are formed.

A further object of this invention is to provide such a scissors sharpening apparatus which offsets the unbalanced weight of the scissors handle.

A still yet further object of this invention is to provide such a scissors sharpening apparatus which can be effectively used for a wide range of sizes and shapes of scissors.

In accordance with this invention a scissors sharpening apparatus includes a disk type rotatable sharpening member having an abrasive surface which can be supported on a ferromagnetic surface for sharpening a scissors blade. A magnetic guide is disposed for positioning the scissors blade at a fixed angle relative to the principal plane of the abrasive surface. The magnetic guide contains a magnet with the axis of its poles oriented nominally perpendicular to the flat face of the blade and nominally parallel to the principal plane of the abrasive.

In a preferred practice of this invention the abrasive surface of the sharpening member is shaped as a section of a cone rather than being a flat surface perpendicular to its axis of rotation.

In a preferred form of this invention the guide system also includes a spring holder which in connection with a cone shaped disk and the magnetic guide functions to effectively position and support the blade so that the user is not compelled to hold the blade totally perpendicular to the shaft of the sharpening member:

THE DRAWINGS

FIG. 3 is a cross-sectional view in elevation of a portion of the scissors sharpening apparatus shown in FIGS. 1-2 showing the scissors mounted in place for sharpening;

FIG. 4 is a front elevational view partly in section similar to FIG. 1 in a different phase of operation;

FIG. 5 is a view similar to FIG. 4 of a modified form of this apparatus;

FIG. 6 is a top plan view of the apparatus shown in FIG. 5;

FIG. 7 is a top plan view of a prior art scissor sharpening member;

FIG. 8 is a view similar to FIG. 7 of a sharpening member in accordance with this invention; and FIGS. 9A-9D are profiles of different scissors blades that may be sharpened with the apparatus of this invention.

DETAILED DESCRIPTION

Figure 2:
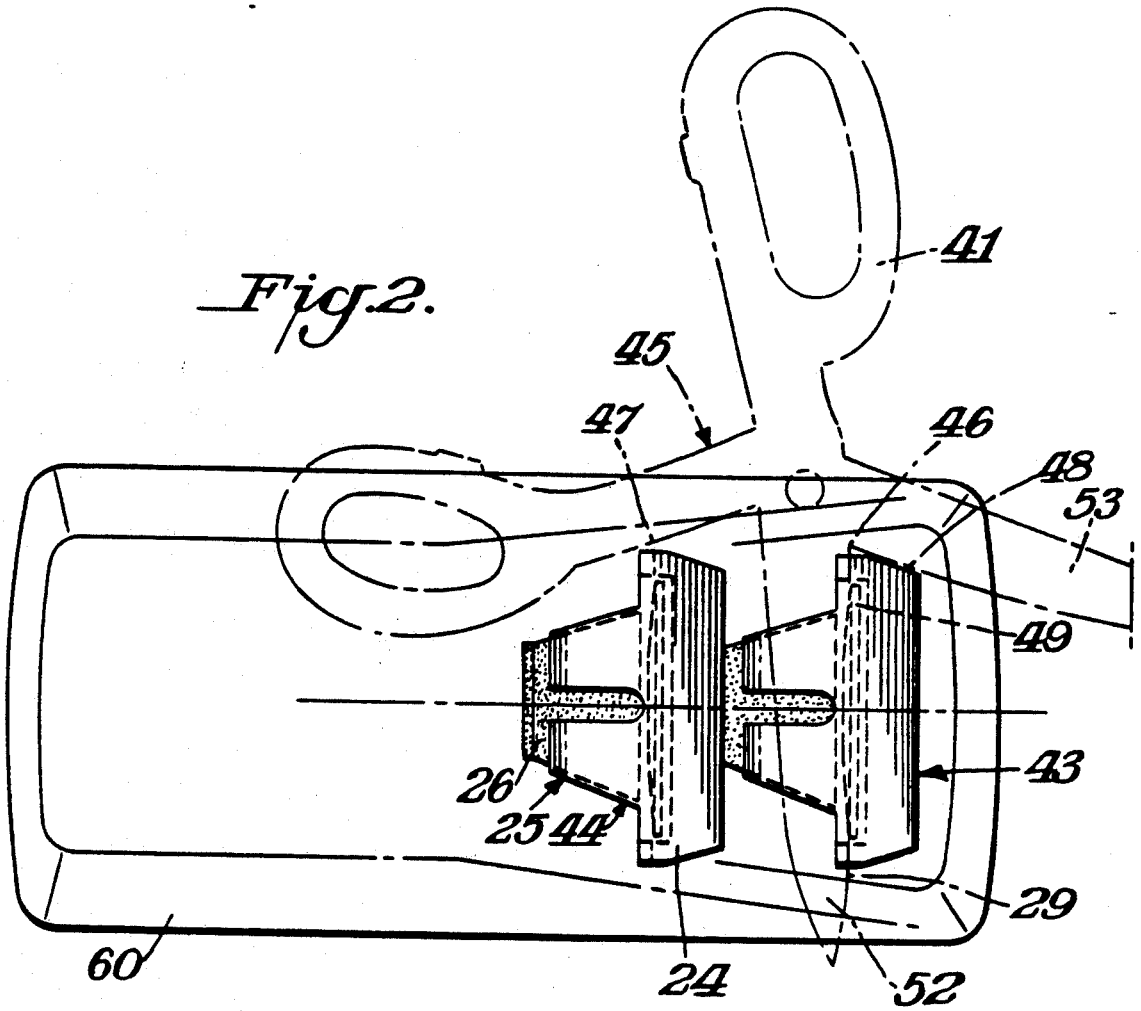
FIG. 2 is a top plan view of a scissors sharpening apparatus of FIG. 1 with the scissors shown in phantom.

As can be appreciated the present invention overcomes the disadvantages of conventional scissor sharpeners while providing an apparatus which is convenient to operate and capable of being used on a wide variety of different scissors.

The present invention is based on a disk type sharpener used so that the scissors blade edge and cutting edge facet are held at a fixed angle to the face of an abrasive disk sharpening member. The abrasive surface of the disk-type member, contrary to prior art sharpeners, is beveled to its axis of rotation. Thus, instead of the disk surface being entirely perpendicular, i.e. 90° to its axis of rotation, it is contoured so that the peripheral portion of the working abrasive face makes an angle typically 80°-85° to its axis of rotation. The scissor is held at a suitable angle so that the working area of the abrasive face makes an angle of 72°-88° with the flat face of the scissor blade. An abrasive surface used in this manner has several favorable characteristics compared to grinding wheels, bevel-edge disk sharpeners and rectangular motion sharpeners in that:

a. the abrasive disk or sharpening member of this invention moves the abrasive elements simultaneously across portions of the scissor edge in a variety of directions such as essentially into the scissor edge, away from the edge, and parallel to the edge. This characteristic has the advantage of minimizing burr formation and removing substantial portions of any burr that is formed compared to a strictly rectangular motion.

b. a disk so used with a blade positioning and holding system of this invention which comprises a unique magnetic guide and a spring holder for the scissor blade has further advantage because the user is not compelled to hold the blade edge totally perpendicular to the shaft (holding the disk) but instead can rotate the blade over a range of 5° or so while sharpening. This eliminates the need to align the blade with great accuracy and importantly allows the user to rock the blade edge relative to the abrasive disk surface thus virtually eliminating the chances of gouging the cutting edge with the outer edge of the disk.

The disk sharpener of the present invention overcomes disadvantages of prior art abrasive disk sharpeners by employing with a beveled face abrasive disk, a unique contiguous precision scissor guide. There is a small gap, preferably less than 0.1 inch, between the guide and disk when at rest. The guide can control reliably and accurately hold the scissor at a predetermined position and fixed angle relative to the principal plane of the disk irrespective of the scissor blade cross-section, thickness or shape and contour. Because the guide is contiguous to the disk and because its guide face extends along and across the entire disk surface near the smartening line, it gives unusually good support to the scissors and allows precision sharpening of virtually the entire scissor edge even with short scissors. The scissor must be held firmly enough by the guide and in a manner that maintains invariently the relative scissor/disk sharpening angle along the entire length of the edge facet being sharpened. Preferably this guide is of the magnetic type. This guide together with other features of this invention cooperate to eliminate the tendency of prior art disks to grab and often forcibly cause the user to lose physical control of the scissors when positioned parallel to the disk face, to lose control of the edge sharpening angle and to gouge, scallop or put undesirably grooves in the scissor blade.

The magnetic guide has a magnetic guide surface in a plane at an angle to and intersecting the abrasive surface to form a line of intersection therewith. The magnetic guide contains a magnet with north and south pole planes that are substantially parallel to the line of intersection. Each of the pole planes is essentially parallel to the guide surface and its extension is contiguous to the abrasive surface. The magnetic guide surface on which the scissor blade slides extends so as to be contiguous to the abrasive surface with its contiguous edge being spaced by a distance less than 0.1 inch and preferably about 0.030 inch from the abrasive surface. The resultant magnetic field at the abrasive surface on a metal substrate creates a steady force which not only holds the scissor at its lower face, but also urges the blade toward the abrasive disk and into contact with the abrasive disk and then maintains that contact because of the substantial attraction created by the magnetic current through the blade, to the disk and back through the magnet poles. The magnetic means in a preferred embodiment employs a ferromagnetic plate of special shape to cover all or most of that face of the magnet removed from the blade with extensions of that plate along the sides of the magnet between the pole faces extending toward that pole adjacent to the blade and terminating at the face of the adjacent pole or terminating at a distance on the order of 0.001 to 0.060 inch from that face. In one configuration the side extensions are tapered in that the extension is closer to the adjacent pole at a point closer to the abrasive disk and more distinct at points further removed from the disk. In addition the magnetic field removes sharpening debris away from the abrasive surface while the scissor is being sharpened thus preventing loading of the abrasive in a manner somewhat similar to the knife sharpener disclosed in U.S. Pat. No. 4,627,194.

In addition to the holding action of the magnetic guide, in order to further offset the unbalanced weight of the scissors handle, a mechanical spring system can be used, when necessary, to add additional force to hold the scissor blade in contact with the magnetic guide. This mechanical spring arrangement is unique in that it is capable of adapting to any blade contour and length, from 4" to 12". The superior sharpening performances and improved scissor edges that have been demonstrated for heavy blades rely in part on this unique combination of magnetic and spring effects that steady the scissor blade and apply a desirable force level on the scissor cutting edge facet as it rests against the diamond abrasive. For lighter scissors the spring is designed to modify its shape, and thus the location of the applied force, to hold the lighter scissors at the point adjacent to the abrasive disk.

In one configuration the mechanical spring system consists of a dual U-shaped spring on its side where, for example, the upper spring leaf is attached on its right end to the sharpener body and is connected on its left end to a lower spring leaf by a thicker transition plastic section which functions as a hinge and corresponds to the rigid arch of the U-shape. The right end of the lower spring leaf in this example is adjacent to the abrasive disk. The uniqueness of this invention has been demonstrated with various size scissors. For light scissors, typically 4 inches in length, the small cross section of the blade causes the lower leaf to be deflected at a point adjacent to the abrasive disk, thus flexing the lower leaf over its entire length with the thicker transition plastic hinge acting as the fulcrum for the lower spring leaf. In a typical construction, the lower spring material is 0.025–0.035" Delrin plastic with the lower spring leaf being 0.75" long from its tip, at the abrasive disk, to the thicker, typically 0.080" thick, transition plastic hinge. Under these conditions the spring force holding the small scissors against the guide will be in the range of 2 oz. to 8 oz. For heavy scissors, typically up to 12 inches in length, the larger cross section of the blade causes the deflection point of the lower leaf to move toward the fulcrum, e.g. the thicker transition plastic hinge. The spring is designed so that under this circumstance, the movement of the fulcrum acts to bend the upper spring leaf causing an added hold down force to be developed on large scissor blades by the upper spring leaf. The fulcrum for the upper spring leaf is at the point where the spring leaf is attached to the body of the scissor sharpener. In a typical construction, the upper spring material is 0.025 to 0.050" Delrin plastic with this spring leaf being about 0.5" in length from the thicker transition plastic hinge to the attachment point. Under these conditions the force created by the spring holding the large scissors against the guide will be in the range of 8 oz. to 16 oz. The thickness and effective length of the upper and lower spring leafs are optimized in the preferred embodiment to accommodate a wide range of scissor sizes. The data cited heretofore is for illustrative purpose only. The spring can of course be made of a suitable metal.

Gouging and scalloping with disk sharpeners can occur due to lack of control of the amplitude of applied force between the scissor and the rotating disk. As previously noted, the applied force in prior art disk sharpeners is a strong function of the operator's techniques and skill, the scissor thickness and geometry, and other design factors. To eliminate this in the present invention, the handle of the scissor is positioned by the operator so that the scissor blade rests on the guide plane established by the face of the guide, which in a preferred case is magnetic, and the scissor blade is moved downward and toward the disk until its cutting edge facet contacts the rotating disk, moves the disk some distance against an appropriately selected biasing force, and then if the operator pushes further the facet will come to rest firmly against two precisely located stops appropriately located contiguous to, defined here as immediately adjacent to but not touching, the circumference of the disk that limit further movement of the scissor blade as it presses against the disk and forcibly align that cutting edge facet essentially parallel to the average plane of the rotating disk. The average plane of the disk face during displacement remains parallel to its plane in the rest position. The extent of displacement of the disk is determined by the position of the disk face in its rest position, the applied hand force, and in the limit by the location of the stops that act only against the scissor blade cutting edge facet, that facet which is also in contact with the face of the disk. The use of such stops across which the scissor blade cutting edge facet is moved precisely locates that facet during sharpening and does not damage the cutting edge itself. With the guide contiguous to the disk surface and with stops that act only on the cutting edge facet, the sharpening angle can be maintained precisely without error introduced by the scissor blade thickness or curvature of the bevel face of the scissor blade.

In a preferred embodiment the rotating disk, mounted on the armature shaft of a suitable motor, is biased to urge it toward the guide by a means such as a spring or the force of motor magnetic effects acting on the armature. Additional restraining means are provided to limit the disk motion so that, in rest position, with the scissor blade removed, the disk face is immediately adjacent to but not touching the scissor blade magnetic guide. The force constant of this biasing means acting on the disk directly or indirectly uniquely determines the force applied by the abrasive disk face on the scissor blade cutting edge facet once the scissor contacts and moves the disk laterally and the cutting edge facet comes to rest on the provided stops. In this manner the disk remains at all times "spring loaded" against the cutting edge facet during sharpening. When the disk is attached rigidly to the motor armature shaft, the motor can be designed to permit enough uninterrupted lateral motion (end play) of the armature and its shaft to accommodate the lateral displacement of the disk between its rest position and its displace position as established by the position of the cutting edge facet when against the stops.

In this preferred embodiment, the motor armature and shaft, with the abrasive disks firmly attached thereto is physically displaced so that the armature mechanical center line is offset from the armature magnetic center in a direction toward the disk. In this configuration, a magnetic bias force is developed holding the armature against a mechanical restraining surface which can be located in the motor at a shaft end, or otherwise thus positioning the abrasive disk adjacent to but not touching the scissor blade magnetic guide. This armature magnetic biasing force acts in combination with the scissor blade magnetic guide to develop a unique combination of forces providing an exceptionally smooth and constant abrasive action on the scissor blade cutting edge facet. The combination of forces act on the scissor blade when said scissor blade is placed on the scissor blade magnetic guide surface and moved toward the ferromagnetic abrasive disk. The scissor blade acts as a ferromagnetic plate on top of the magnet to concentrate the magnetic field of the magnet, and, as the scissor blade is moved toward the abrasive disk it closes a magnetic circuit through the abrasive disk to the lower (fixed) ferromagnetic plate (on bottom of magnet). This results in a magnetic force attracting the scissor blade to the abrasive disk. These forces assist the user in bringing the scissor blade cutting edge facet into contact with the abrasive disk. Then as the scissor blade moves laterally with aid of the user, it displaces the disk from its resting position as determined by the mechanical reference surface and the user applies the force needed to move the disk against the armature magnetic force until the scissor blade rests against the provided stops.

The armature magnetic force can be designed to range from about zero to 1.0 pound for typical commercially available motors and for some motors is essentially constant for offsets of 0.050" to 0.150" of armature mechanical center from the armature magnetic center.

In another configuration the armature that drives the disk will be allowed to "float" with its mechanical center free to align itself with the magnetic center of the motor in such a way that the abrasive disk is adjacent to but not touching the scissor blade magnetic guide. For some scissors it may be preferably to take advantage, in part or whole, of a unique force relationship between the magnetic effects created by the magnet and scissor blade on one hand and the magnetic effects created by a "floating" armature on the other. The unique advantage of this arrangement in this invention is that the contact force of the ferromagnetic abrasive disk against the scissor blade cutting edge facet is at the instant of contact very lower since the force generated by the magnet and scissor blade will be in opposition to the magnetic effects acting on the "floating" armature. When the scissor blade moves into contact with the abrasive disk, the disk mounted on the armature shaft will want to move to restore the armature position to its magnetic center. In other words, the armature magnetic force changes direction and starts to work in the same direction as the motion of the scissor blade. As the disk moves it will tend to move the scissor blade with it since the blade is held thereto by magnetic attraction. The net effect of this unique configuration is to provide an abrasive force which on initial contact is very gentle and gradually increases to a maximum when the scissor blade cutting edge facet engages the provided stops. With typical design parameters, the magnetic force attracting the blade to the disk and holding it there can be as low as a fractional ounce increasing to 0.5 pounds for disk displacement of 0.060" to 0.100". Thus this invention provides several unique means to attract the scissor blade to the abrasive disk and simultaneously limit the abrasive force of the disk against the cutting edge facet, the result of which is to provide an exceptionally smooth and precise cutting edge even in the hands of an unskilled operator.

Another configuration uses a leaf spring against the end of the armature shaft opposite the disk to apply the desired biasing force to the disk. The spring can, or course, be located alternatively so as to press directly on the back face of the disk or on some other point along the shaft that supports the disk. The spring force can be essentially uniform with spring displacement or it could be constructed to be non-uniform.

There are many physical configurations that will provide the same biasing action. For example, the motor can be supported so it can be moved by springs biased in direction of the disk. Similarly the disk can be mounted on a separate shaft and driven by means of gears or belts, etc. from the motor shaft where a spring system could act directly on the rear of the disk or on its separate shaft. The stop arrangement which acts on the cutting edge facet minimizes the extent of free travel of the disk needed to accommodate the wide variety in size and professional or styles of household scissors.

The ability to control the force of the scissor blade cutting edge facet during sharpening can be realized by allowing the scissor holder to move away precisely from a stationary disk to accommodate scissor blades of different thicknesses. The disk is stationary in this latter example in that it is not free to move laterally in a direction along its axis of rotation. In that case a spring or other biasing means would act on the holder in a manner to press it in the direction toward the stationary disk. However in rest position with scissor blade removed the holder would be contiguous to but not allowed to touch the disk.

Regardless of the means used to control the abrading force during sharpening it is important that the design be such that the required movement of the disk or holder can be realized without a significant change to the sharpening angle, defined here as that angle formed by the plane of the guide on which the face of the scissor blade rests relative to the principal plane of the abrasive disk, irrespective of blade thickness, width, or length. Neither the disk face or the holder should be allowed to tilt as their relative separation distance changes. For example, where the disk is the moving element, the average plane of the abrasive disk should, during lateral motion of the disk, remain parallel to the principal plane of the disk in its rest position.

As further protection against damage to the scissor edge from overheating during sharpening, it is desirable to use a motor with adequate power for sharpening but not of such higher power as to cause serious damage to the edge if the scissor blade accidentally jams and stalls the disk. The disk diameter determined in part the force delivered to the scissor, and the velocity and mass of the rotating system also influences the force and kinetic energies involved at scissor edge if the disk stalls. A disk diameter of 1 to 3 inches and a motor with running torque on the order of 9 inch-ounces works well and minimizes the danger of damaging the scissor blade. A disk diameter of this order generally provides adequate contact area to spread the sharpening energy over a sufficient scissor blade length to give uniform sharpening action along the cutting edge facet. Disks of other diameters can be used with appropriately selected motors. A friction clutch can be used as another means to control the forces, torques, and energy deliverable to the disk.

Figure 1:
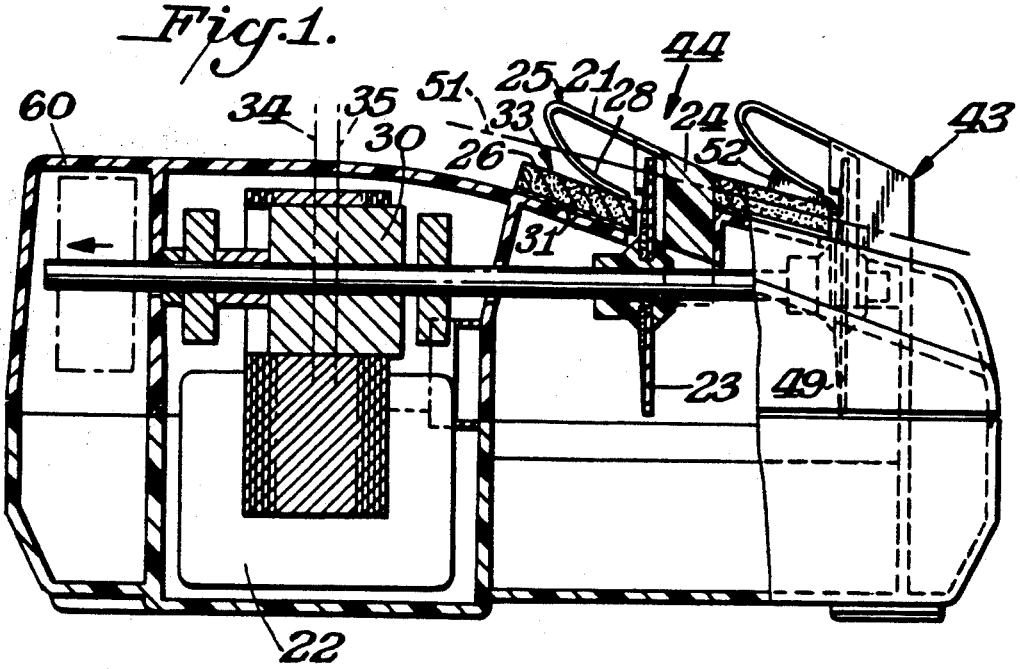
FIG. 1 is a side elevational view partly in section of a scissors sharpening apparatus in accordance with this invention.

FIGS. 1 through 3 illustrate, by way of example, a preferred configuration of an abrasive disk scissor sharpener incorporating the features of this invention herein. On a base plate within housing or enclosure 60 is mounted to a motor 22 whose right shaft has an abrasive disk 23 or sharpening member firmly attached on the shaft. The disk is surrounded by a plastic enclosure 24 with a spring mechanism 25 protruding to the left and downward ending at a magnet surface 26 and just in front of the abrasive face of disk 23.

The scissor blade 27 (FIG. 3) placed on the magnet surface 26 and moved toward the abrasive disk face 23 causes the lower leaf 28 of the spring mechanism 25 to move up, following the upper contour of the scissor blade. Thus a force normal to the magnetic means surface 26 is exerted by the lower spring leaf 28 holding the scissor blade on to the magnetic surface. 26. As the scissor blade cutting edge facet 29 contacts the abrasive disk face 23 it moves the abrasive disk 23 to the right against the biasing force produced by the motor armature 30 (FIG. 1) until the scissor blade cutting edge facet contacts the stops 32 FIG. 4) built into the plastic enclosure 24. The scissor blade 27 rests against the magnetic surface 26 with its cutting edge facet 29 formed by the abrasive action parallel to and resting against the face of disk 23. The magnetic circuit created by the scissor blade 27, the ferromagnetic abrasive face coated disk 23 and the magnetic base plate 31 continues to provide an attraction between the blade and disk. The before mentioned biasing force provides also a spring-like force holding the abrasive disk against the scissor blade cutting edge facet.

Stops 32, integrally part of the plastic enclosure 24 opposite the magnet means 33 establish in a positive manner the limit of motion of the vertical cutting edge facet of the scissor blade in the direction of the abrasive disk 23 and in combination the angle of the magnetic surface 26 establish positively the position of the cutting edge facet on the abrasive disk 23 during sharpening. The stops 32 act only on the vertical cutting edge facet. Those positions of the vertical faces of enclosure 24 that act as the stops 32, are positioned so that when the vertical cutting edge facet is against the enclosure 24 at those points designated as stops 32, the line of that facet is parallel to the principal plane of the abrasive disk. The stopping action can be obtained by designing and locating stops 32 independent of the enclosure 24 but in any event, the stops 32 should be contiguous to but not touching the circumference of the disk holder. The stops 32 if made of material independent of enclosure 24 can be made of any of a wide variety of materials such a high lubricity plastic, a metal such as martensitic steel, a metal roller, or even of a mild abrasive material similarly located that will remove burrs or mildly abrade the facet surface as it is moved over the surface of the stop.

FIG. 3 includes in cross-section the illustrative magnetic guide and mechanical spring mechanism that contains the magnetic means 33 that establishes the guide plane for the scissor blade and lower spring leaf 28 that provides the force to hold the scissor blade firmly against the upper magnetic surface 26. The angle of the scissor blade resting on the guide plane is established relative to the average plane of the disk by the rigid magnetic means 33. The magnetic means 33 includes an upper North pole and a lower South pole with the polar axis of the magnetic means 33 nominally parallel (i.e. set at an angle up to 25° or so) to the abrasive disk 23 and with the end of the magnetic means in close proximity to the disk. A magnetic circuit is formed by the scissor blade 27 resting in close proximity to the North pole face of magnet 26, the abrasive coated ferromagnetic disk 23 and the magnet ferromagnetic base plate 31 attached to the South pole face of the magnet 26. In contrast with the magnetic circuit such as described in U.S. Pat. No. 4,716,689, the blade constitutes an upper ferromagnetic pole plate for the magnet and the purpose of this circuit is to develop a magnetic force pulling the disk toward the cutting edge facet of the scissor blade 27 or pulling the blade toward the disk. The blade forms a ferromagnetic plate for the upper pole concentrating that pole's flux in the blade and directing it to the disk. The disk is a critical part of the magnetic circuit while in the reference patent the blade shorts the magnetic field when the blade is in place and little to no flux passes through the abrasive plate. Therefore, with the cutting edge facet of the scissor blade firmly against the stop 32 the force of the abrasive disk against the cutting edge facet is fixed and predetermined by the aforementioned spring or magnet circuit acting in combination with the offset of the motor armature center line 35 from its magnetic field center line 34 as shown in FIG. 1. The magnetic poles can, of course, be reversed from those used in this example.

The unique magnetic structure of the magnetic means in combination with the abrasive coated metal disk and the force created by the center action of the motor armature can provide an unusually smooth contact between the scissor blade and the abrasive. As the scissor blade moves down the plane of the magnetic means, it is attracted toward the disk and if the disk is free to move along its axis, it will move toward the blade acting against the magnetic field that tries to center the motor armature. Depending on the relative magnetic force created between the magnet and disk on the one hand and by the displacement of the armature on the other the force between the blade and disk can be low at the instant of their contact as the disk and blade move together. This has the advantages of providing a smooth abrasive action at the instant of contact between the scissor blade and the disk with no scalloping or roughness due to user instituted force variations.

The mechanical spring mechanism 25 of FIGS. 3-4 includes a top leaf spring 21 a lower leaf spring 28 which are integrally connected via a thicker transition plastic hinge 36. This mechanical spring is an improvement over the simple magnetic force generated normal to the surface of the magnetic element 33 as it relates to scissor sharpening. Scissors present a major unbalanced weight in that the scissor handle is located several inches off the axis of the sharpener. Thus a force normal to the magnet must be larger than that typically available with a small permanent magnet. In one configuration of this invention, the mechanical spring mechanism 25 (FIG. 4) operates in combination with the magnet element 33 to produce a combination normal hold down force. The normal force developed by the magnetic element 33 can be designed to be concentrated at the cutting edge facet of the scissor blade 27 by shaping the sides of the magnetic element base plate 31, as shown in FIGS. 3 and 4, while the force developed by the mechanical spring mechanism is distributed to the scissor blade 27 according to the size and contour shape of the scissor blade. FIG. 3 shows how only the lower leaf 28 of the spring mechanism 25 is deflected when small scissors are being sharpened. FIG. 4 shows how, with a thicker blade, both the upper leaf 21 and lower leaf 28 are both deflected through the transition hinge 36. The transition hinge 36 is thicker than either the lower blade 28 or upper blade 21 so that when a small scissor blade is encountered the lower leaf 28 deflects with the transition hinge 36 acting as the fulcrum. On the other hand when a large scissor blade is encountered the lower leaf lever arm becomes very short (and stiff) thus forcing the upper hinge to deflect at the point 37 where the upper hinge is connected to the plastic enclosure 24. In this case the transition hinge 36 merely transmits the force from the lower leaf 28 to the upper leaf 21.

FIGS. 5-6 illustrate a variation of spring mechanism 25 wherein a cushioning member 19 preferably made of a high density elastomeric foam material such as Poron® is mounted between upper leaf 21 and lower leaf 28.

FIG. 8 shows the preferred embodiment for the abrasive disk 23. FIG. 8 is a top view of the scissor sharpener with the motor shaft 38 shown to be vertical and the abrasive disk face is beveled relative to the shaft by the angle which will range from 80°-88°. In this configuration, the beveled disk face is a cone whose axis is the axis of the shaft. If the scissor blade were to intersect this conical surface in a plane parallel to the axis of the cone and be displaced from the axis of the shaft, the intersection is a parabola. In this invention, the scissor blade is in a plane inclined 15°-20° to the axis of the one (abrasive surface) and displaced from the axis of the shaft by approximately 0.6-0.7", where the intersection (or path of the scissor blade across the abrasive surface) is a section of an ellipse. In either case, the path of the scissor blade across the face of the abrasive disk, when the scissor blade is rocked in its plane, results in a broad sharpening area of contact.

The advantage of the beveled face feature of this invention for scissor sharpening can be understood by visualizing the motion of the scissor blade in the plane of the magnetic guide surface 26 of FIG. 1. As the scissor blade is pulled through the sharpener, there is a tendency by the user to rock the scissor blade 27 as shown in FIGS. 7 and 8. In the case of the beveled face of this invention, shown in FIG. 8 as the scissor blade 27 is rocked about the right stop 32, the abrasive disk face moves toward the scissor blade thus presenting a broad sharpening surface 39 to the cutting edge facet of the scissor blade 27. In this way smooth sharpening is obtained even if the user is imprecise in the manner of pulling the blade through the sharpener.

On the other hand, in the case of the perpendicular abrasive face 23A shown in FIG. 7, as the scissor blade 27 is rocked about the right stop 32, the abrasive disk moves toward the scissor blade thus presenting the abrasive disk edge 40 to the cutting edge facet of the scissor blade 27. In this case severe gouging G will take place at the cutting edge facet resulting in heavy burrs and a rough cutting edge 29A.

All the features discussed in FIGS. 1-4 and 8 are required to give a smooth, high precision, cutting edge to the widest variety of scissors by the unskilled lay person. FIGS. 9A-9D are illustrative of the variety of scissor cross-sections that are accommodated by this invention.

FIGS. 1 and 2 illustrate that scissors and knives differ in major ways and thus require major improvements over current devices used either for knife sharpening or for scissor sharpening. Scissors present a major unbalanced weight in that the scissor handle 41, is located several inches off the axis of the sharpener. This off balance force is counter balanced by the mechanical spring mechanism 25 thus keeping the scissor blade 27 firmly in contact with the magnetic guide plane of surface 26. Another major difference is that scissors vary in their handle design from straight handles to the bent handles shown in FIGS. 1 and 2. A feature of this invention is to provide all the improvements heretofore mentioned in a contour embodiment that will accommodate all scissors from straight handles to bent handles.

The contour of the scissor sharpener in the critical areas of the sharpening stations can be visualized in FIG. 2. There are two stations 43 and 44. FIG. 2 shows scissors 45 in position for sharpening in the honing station 43. These scissors are typical of the bent handle style where the enclosed angle of the bent handle is typically 140°-150°. The contour of stations 43 and 44 must be such that the "nip" of the scissors 46 will be within ⅛" of the abrasive disk edge 49 before the bent handle interferes with station 44 at location 47 which is typically ⅝" to 1" to the left of abrasive disk 23 and before the bent blade interferes with station 43 at 48 which is typically ⅜" to ½" to the right of abrasive disk edge 49. Since the scissor sharpener must accommodate both right and left handed scissors, this contour must be symmetrical about the scissor sharpener center line.

FIG. 1 shows the plane 51 of the bottom surface of the "free" blade 53 while the blade 52 being sharpened is shown in station 43. The handle interference point 47 and blade interference point 48 are regions defined in the plane 51 over the distance ranges from the respective abrasive disks 49 and 23, herein mentioned.

In the preferred practice the sharpening apparatus would have two stations 43,44 which are essentially identical except for the grit size of the abrasive on each disk. One grit size is used for presharpening and another grit size for honing.

What is claimed is:

1. A sharpening apparatus for sharpening a cutting implement blade comprising a ferromagnetic disk having an abrasive surface, motor means for rotating said disk, a magnetic guide means for positioning the blade at a fixed angle relative to said abrasive surface, said magnetic guide means including a magnet having magnetic poles oriented with their axes nominally perpendicular to the flat face of the blade and nominally parallel to said abrasive surface, and said magnetic guide means being juxtaposed and slightly spaced from said abrasive surface for supporting the blade in contact with said abrasive surface whereby a magnetic current pay flow from said magnet and through the blade end through said metallic disk and back to said magnet to maintain the blade in contact with said abrasive surface, said magnetic poles comprising a first magnet pole and a second magnet pole, said magnet having a blade guide surface at said second magnet pole, a ferromagnetic pole plate disposed against said first magnet pole remote from said blade guide surface to concentrate the magnetic flux of said first magnet pole remote from the cutting implement with the blade itself constituting a second and movable pole plate which concentrates the magnetic flux of said second magnet pole that is essentially adjacent to the blade, wherein the polar axis of said magnetic guide means can be parallel or up to 30° relative to said abrasive surface, and said ferromagnetic pole plate including a first ferromagnetic pole piece shaped to include a lower nominally flat section in nominal contact with and nominally parallel to the plane of said first magnet pole with extensions of said flat section that extend along the sides of said magnet in the direction of said second magnet pole.

2. A sharpening apparatus according to claim 1 wherein said extensions of said first pole piece are tapered to bring said first pole piece closer to said second pole at points nearer to said abrasive surface and more remote from said second pole at points more distant from said abrasive surface.

3. A sharpening apparatus according to claim 2 wherein said magnetic current create increasingly greater flux immediately adjacent to said abrasive surface to attract the blade toward said abrasive surface and into intimate contact with said ferromagnetic substrate with force sufficiently large to require measurable force to move the blade away from said abrasive surface.

4. A sharpening apparatus for sharpening a scissor blade and the like comprising a ferromagnetic disk having an abrasive surface, motor means for rotating said disk, a magnetic guide means for positioning the scissor blade at a fixed angle relative to said abrasive surface, said magnetic guide means including a magnet having magnetic poles oriented with their axes nominally perpendicular to the flat face of the blade and nominally parallel to said abrasive surface, and said magnetic guide means being juxtaposed and slightly spaced from said abrasive surface for supporting the blade in contact with said abrasive surface whereby a magnetic current may flow from said magnet and through the blade and through said metallic disk and back to said magnet to maintain the blade in contact with said abrasive surface, and a mechanical hold-down means having leaf spring elements to contact the top surface of the blade and apply an added force to hold the blade securely against the guide surface of said magnetic means.

5. A sharpening apparatus for sharpening a scissor blade comprising a ferromagnetic disk having an abrasive surface, motor means for rotating said disk, a magnetic guide means for positioning the scissor blade at a fixed angle relative to said abrasive surface, said magnetic guide means including a magnet having magnetic poles oriented with their axes nominally perpendicular to the flat face of the blade and nominally parallel to said abrasive surface, and said magnetic guide means being juxtaposed and slightly spaced from said abrasive surface for supporting the blade in contact with said abrasive surface whereby a magnetic current may flow from said magnet and through the blade and through said metallic disk and back to said magnet to maintain the blade in contact with said abrasive surface, said motor means rotating said disk having said abrasive surface by means of a shaft which in turn is driven by a motor armature, said armature being free to move along its axis in the direction of the axis of said shaft with said armature restrained by the magnetic forces of the motor to remain in its magnet neutral position requiring an external force applied to said shaft or to said abrasive surface to displace said shaft and said armature from the neutral position.

6. A sharpening apparatus according to claim 5 wherein sad motor armature upon being displaced from its magnetic neutral position creates a biasing force to hold said motor armature and said shaft against a mechanical reference surface biasing force requiring an external force greater than said biasing force to displace said abrasive surface from its resting position.

7. A sharpening apparatus for sharpening a blade comprising an enclosure, a cutout in said enclosure comprising a sharpening station, a disk in said enclosure extending into and exposed from said sharpening station, an abrasive surface on said disk, motor means in said enclosure for rotating said disk, a guide structure in said sharpening station for supporting the blade when the cutting facet of the blade is in contact with said abrasive surface, a mechanical holding device disposed above said guide structure to press the blade against said guide structure, said mechanical holding device being a U-shaped spring having an upper leaf and a lower leaf connected to each other by a hinge section, one of said leaves being disposed for pressing against the blade, and the free end of the other of said leaves being fixedly mounted with said hinge section disposed remote from said disk.

8. A sharpening apparatus according to claim 7 wherein said guide structure is a magnetic guide structure.

9. A sharpening apparatus according to claim 8 wherein said hinge section is thicker than said upper leaf and said lower leaf.

10. A sharpening apparatus according to claim 9 including a cushioning member between said upper leaf and said lower leaf.

11. A sharpening apparatus according to claim 7 wherein said abrasive surface is a segment of a cone.

12. A sharpening apparatus according to claim 7 including a pair of said sharpening stations in said enclosure, each of said sharpening stations having a cutout and a rotatably mounted disk with an abrasive surface, and the abrasive on said abrasive surfaces being of different grit size whereby one of said abrasive surfaces may be used for presharpening and the other of said abrasive surfaces may be used for honing.

13. A sharpening apparatus according to claim 7 wherein said disk is mounted in a laterally biased manner for urging said disk toward said guide structure.

* * * * *